US005203884A

United States Patent [19]

Buchanan et al.

[11] Patent Number: 5,203,884

[45] Date of Patent: Apr. 20, 1993

[54] ABRASIVE ARTICLE HAVING VANADIUM OXIDE INCORPORATED THEREIN

[75] Inventors: Scott J. Buchanan, Minneapolis; Eric D. Morrison, West St. Paul; David R. Boston, Woodbury; Steven T. Hedrick; William L. Kausch, both of Cottage Grove; Wayne K. Larson, Maplewood, all of Minn.

[73] Assignee: Minnesota Mining and Manufacturing Company, St. Paul, Minn.

[21] Appl. No.: 893,491

[22] Filed: Jun. 4, 1992

[51] Int. Cl.[5] ..... B24D 11/00

[52] U.S. Cl. ..... 51/295; 51/293; 51/298; 51/307; 51/308; 51/309; 525/255

[58] Field of Search ..... 51/293, 295, 298, 307, 51/308, 309; 525/255

[56] References Cited

U.S. PATENT DOCUMENTS

| | | | |
|---|---|---|---|
| 3,163,968 | 1/1965 | Nafus | 51/394 |
| 3,168,387 | 2/1965 | Adams | 51/295 |
| 3,377,264 | 4/1968 | Duke et al. | 204/290 |
| 3,624,034 | 11/1971 | Price et al. | 260/49 |
| 3,734,874 | 5/1972 | Kibler et al. | 260/29.2 |
| 3,779,993 | 12/1973 | Kibler et al. | 260/75 |
| 3,821,281 | 6/1974 | Radlmann et al. | 260/470 |
| 3,942,959 | 3/1976 | Markoo et al. | 51/295 |
| 3,992,178 | 11/1976 | Markoo et al. | 51/295 |
| 3,998,870 | 12/1976 | Carlson | 260/470 |
| 4,052,368 | 10/1977 | Larson | 260/75 |
| 4,104,262 | 8/1978 | Schade | 528/295 |
| 4,203,769 | 5/1980 | Guestaux | 430/631 |
| 4,304,901 | 12/1981 | O'Neill et al. | 528/290 |
| 4,307,219 | 12/1981 | Larson | 528/71 |
| 4,330,588 | 5/1982 | Larson et al. | 428/264 |
| 4,408,008 | 10/1983 | Markusch | 524/591 |
| 4,478,907 | 10/1984 | Van Gossum et al. | 428/327 |
| 4,503,198 | 3/1985 | Miyai et al. | 525/440 |
| 4,558,149 | 12/1985 | Larson | 560/14 |
| 4,638,017 | 1/1987 | Larson et al. | 521/157 |
| 4,738,992 | 4/1988 | Larson et al. | 521/157 |
| 4,746,717 | 5/1988 | Larson | 528/68 |
| 4,826,508 | 5/1989 | Schwartz et al. | 51/293 |
| 4,855,384 | 8/1989 | Larson | 528/60 |
| 4,908,155 | 3/1990 | Leemans et al. | 525/255 |
| 4,943,488 | 7/1990 | Sung et al. | 51/295 |
| 4,978,740 | 12/1990 | Kawamoto et al. | 528/272 |
| 5,006,451 | 4/1991 | Anderson et al. | 430/527 |
| 5,049,164 | 9/1991 | Horton et al. | 51/295 |
| 5,061,294 | 10/1991 | Harmer et al. | 51/295 |
| 5,085,671 | 2/1992 | Martin et al. | 51/293 |
| 5,108,463 | 4/1992 | Buchanan | 51/295 |
| 5,137,542 | 8/1992 | Buchanan et al. | 51/295 |

FOREIGN PATENT DOCUMENTS

| | | |
|---|---|---|
| 54-152197 | 11/1979 | Japan . |
| 58-171264 | 10/1983 | Japan . |
| 61-152373 | 7/1986 | Japan . |

OTHER PUBLICATIONS

"Electric Moments of the Simple Alkyl Orthovanadates," Cartan et al., *J. Phys. Chem.*, 64 (1960), pp. 1756–1758.

"Mixed-Valence Polyvanadic Acid Gels," Gharbi et al., *Inorg. Chem.*, 21, (1982), pp. 2758–2765.

"Synthesis of Amorphous Vanadium Oxide from Metal Alkoxide," Hioki et al., *Nippon Seramikkusu Kyokai Gakujutsu Ronbunshi*, 97, (6), (1989), pp. 628–633.

(List continued on next page.)

*Primary Examiner*—Mark L. Bell
*Assistant Examiner*—Willie J. Thompson
*Attorney, Agent, or Firm*—Gary L. Griswold; Walter N. Kirn; Gregory D. Allen

[57] ABSTRACT

An abrasive article (i.e., a coated abrasive article or a three-dimensional, low density abrasive article) having a sufficient amount of vanadium oxide incorporated therein to provide having a reduced tendency to buildup static electricity during the abrading of a workpiece. Preferably, the abrasive article further comprises a compatible binder (preferably, a sulfonated polymer) to aid in securing the vanadium oxide to the abrasive article. In another aspect, a method of making the same is taught.

32 Claims, No Drawings

OTHER PUBLICATIONS

"Synthesis of $V_2O_3$ Gels from Vanadyl Alkoxides," Hirashima et al., *Nippon Seramikkusu Kyokai Gakujutsu Ronbunshi,* 97, (3), (1989), pp. 235–238.

"Vanadium Pentoxide Gels," Livage, *Chem. Mater.,* 3, (1991), pp. 578–593.

"Sol-Gel Synthesis of Vanadium Oxide from Alkoxides," Nabavi et al., *Eur. J. Solid State Inorg. Chem.,* 28, (1991), pp. 1173–1192.

Abstract for "Colloidal Vanadium Pentoxide," Ostermann, *Wiss. U. Ind.,* I, (1922), pp. 17–19.

Abstract for "Vanadic Acid Esters and Some Other Organic Vanadium Compounds," Prandtl et al., *Z. Anorg. Chem.,* 82, pp. 103–129.

"Synthesis and Characterization of Vanadium Oxide Gels from Alkoxy-Vanadate Precursors," Sanchez et al., *Mat. Res. Soc., Symp. Proc.,* 121, (1988), pp. 93–104.

"The Preparation of Colloidal Vanadic Acid," Wegelin, *Z. Chem. Ind. Kolloide,* 2, (1912), pp. 25–28; and English abstract therefor.

"Preparation of Colloidal Vanadic Acid by a New Dispersion Method," Müller, Z. *Chem. Inc. Kolloide,* 8, (1911), pp. 302–302; and English abstract therefor.

ABRASIVE ARTICLE HAVING VANADIUM OXIDE INCORPORATED THEREIN

BACKGROUND OF THE INVENTION

1. Field of the Invention

This invention pertains to a coated abrasive article and a three-dimensional, low density abrasive article having a vanadium oxide incorporated therein; and a method of making the same. The abrasive articles are useful in reducing the accumulation of the static electric charge during abrading of a workpiece.

2. Description of the Related Art

Coated abrasives, considered the premier tool for abrading and finishing wood and wood-like materials, unfortunately suffer from the generation of static electricity during their use. Static electricity, which tends to be more pronounced when abrading electrically insulating or semi-insulating workpieces, for example, wood (e.g., pine, oak, cherry, etc.), plastic, mineral (e.g., marble), the like (e.g., particle board or pressed board), or workpieces coated with an insulating material (e.g., lacquer), is generated by the constant separation of the abrasive product from the workpiece, the machinery drive rolls, idler rolls, and support pad for the abrasive product. This static charge is typically on the order of 50 to 100 kilovolts.

Static electricity is responsible for numerous problems. For example, a sudden discharge of the accumulated static charge can cause injury to an operator in the form of an electric shock or it can cause the ignition of wood dust particles, which poses a serious threat of fire or explosion. The static charge also causes the sawdust to cling to various surfaces, including that of the coated abrasive, the abrading machine and the electrically insulating wood workpiece, thereby making it difficult to remove by use of a conventional exhaust system. If the static electrical charge is reduced or eliminated, the coated abrasive article can have a significantly longer useful life and the potential for the above-mentioned hazards can be eliminated or reduced.

Many attempts, with varying degree of success, have been made to solve the static electricity problem. One common approach has been to incorporate an electrically conductive or antistatic material into the coated abrasive construction to eliminate the accumulation of electrical charge. For example, U.S. Pat. No. 3,163,968 (Nafus) discloses a coated abrasive article having a coating comprising graphite in the binder on the surface opposite the abrasive material. U.S. Pat. No. 3,168,387 (Adams) discloses a coated abrasive having a metal leaf pigment over the abrasive grains. U.S. Pat. No. 3,377,264 (Duke) discloses an electrically conductive layer, such as a metal foil, overlying the front surface of a coated abrasive.

U.S. Pat. No. 3,942,959 (Markoo et al.) teaches a coated abrasive construction having an electrically conductive resin layer sandwiched between two electrically nonconductive resin layers to prevent the accumulation of electrostatic charge during grinding. In the latter construction, the resin layer is made electrically conductive by incorporating into the resin an electrically conductive filler which may be a metal alloy, metal pigment, metal salt, or metal complex.

U.S. Pat. No. 3,992,178 (Markoo et al.) discloses a coated abrasive article having an outer layer comprised of graphite particles in a bonding resin which reduces the electrostatic charges generated during grinding.

U.S. Pat. No. 4,826,508 (Schwartz et al.) discloses a flexible abrasive member comprising a length of flexible fabric that has been treated to render it electrically conductive, an electrically non-conductive mesh layer applied to one surface of the fabric, said non-conductive mesh layer having a multitude of discrete openings therein, and electrodeposited metal adhering to the electrically conductive fabric in each of the openings, the electrodeposited metal having particulate abrasive material embedded therein.

U.S. Patent No. 5,061,294 (Harmer et al.) teaches a coated abrasive that is rendered conductive by the addition of a doped conjugated polymer.

U.S. Pat. No. 5,108,463 (Buchanan) discloses a coated abrasive article having carbon black aggregates incorporated therein. The presence of the carbon black aggregates reduces the buildup of static electricity generated during abrading.

U.S. application Ser. No. 07/592,223, filed Oct. 10, 1990, now U.S. Pat. No. 5,137,542 which is a continuation-in-part of U.S. application Ser. No. 07/564,715, filed Aug. 8, 1990, now abandoned, (Buchanan et al.) discloses a coated abrasive article having a coating of electrically conductive ink incorporated in the construction thereof, such that the buildup of static electricity during the use of the article is either reduced or eliminated.

SUMMARY OF THE INVENTION

The present invention provides a coated abrasive article comprising:

(a) a backing having a front surface;

(b) an abrasive layer bonded to the front surface of the backing to provide a coated abrasive article, the abrasive layer comprising abrasive grain and a cured bond system; and (c) vanadium oxide incorporated into the coated abrasive article, wherein the vanadium oxide is present in an amount sufficient to reduce the accumulation of static electric charge during the abrading of a workpiece with the coated abrasive article; and a method of making the same.

In another aspect, the present invention provides a three-dimensional, low density (also known as "nonwoven") abrasive article comprising (a) a three-dimensional, low density web structure;

(b) abrasive grain;

(c) a bond system that serves to bond the abrasive grain to the web structure;

(d) vanadium oxide incorporated into the three-dimensional, low density abrasive article, wherein the vanadium oxide is present in an amount sufficient to reduce the accumulation of static electric charge during the abrading of a workpiece with the three-dimensional, low density abrasive article; and a method of making the same.

Preferably, the abrasive article according to the present invention further comprises a compatible binder that aids in securing the vanadium oxide to the coated abrasive article. The compatible binder can be coated over a layer of the vanadium oxide or it can have the vanadium oxide dispersed therein. Preferably, the compatible binder is a sulfopolymer.

In this application:

"compatible binder" refers to a binder that aids in securing the vanadium oxide to the coated abrasive article, and which does not substantially adversely affect the coatability of the dispersion or antistatic properties imparted by the vanadium oxide;

"sulfopolymer" or "sulfonated polymer" means a polymer comprising at least one unit containing a salt of a $-SO_3H$ group, preferably an alkali metal or ammonium salt;

"dispersed sulfonated polymer" means a solution or dispersion of a polymer in water or aqueous-based liquids; particles can be dissolved or they can be dispersed in the liquid medium and can have their largest dimension in the range from greater than zero to about 10 micrometers (typically the largest dimension is less than about 1 micrometer);

"vanadium oxide" means a single or mixed valence vanadium oxide; the formal oxidation states of the vanadium ions are typically +4 and +5; in the art, such species are often referred to as $V_2O_5$; in the aged colloidal form (several hours at 80° C. or more or several days at room temperature), vanadium oxide consists of dispersed fibrillar particles of vanadium oxide which preferably have a thickness in the range of 0.02–0.08 micrometer and length up to about 4 micrometers;

"sol", "colloidal dispersion", and "colloidal solution" are used interchangeably and unless otherwise stated mean a uniform suspension of finely divided particles in a continuous liquid medium;

"front surface" refers to the untreated front surface of the backing or the treated front surface of the backing (i.e., the front surface of the backing having a saturant, the front surface of the backing having a presize, etc.);

"back surface" refers to the untreated back surface of the backing or the treated back surface of the backing (i.e., the back surface of the backing having a saturant, the back surface of the backing having a backsize, etc.);

"top surface" refers to the outermost surface of the abrasive layer or the outermost surface of a component layer of the abrasive layer (i.e., a make layer, a slurry layer, a size layer, a supersize layer, etc.);

"aliphatic" refers to a saturated or unsaturated linear, branched, or cyclic hydrocarbon or heterocyclic radical, and includes alkyls, alkenyls (e.g., vinyl radicals), and alkynyls;

"alkyl" refers to a saturated linear, branched, or cyclic hydrocarbon radical;

"alkenyl" refers to a linear, branched, or cyclic hydrocarbon radical containing at least one carbon-carbon double bond;

"alkynyl" refers to a linear or branched hydrocarbon radical containing at least one carbon-carbon triple bond;

"heterocyclic" refers to a mono- or polynuclear cyclic radical containing carbon atoms and one or more heteroatoms such as nitrogen, oxygen, sulfur or a combination thereof in the ring or rings, including furan, thymine, hydantoin, and thiophene;

"aryl" refers to a mono- or polynuclear aromatic hydrocarbon radical; and

"arylalkyl" refers to a linear, branched, or cyclic alkyl hydrocarbon radical having a mono- or polynuclear aromatic hydrocarbon or heterocyclic substituent.

The vanadium oxide is preferably derived from a colloidal vanadium oxide dispersion (e.g., a sol), and more preferably from an aqueous-based colloidal vanadium oxide dispersion (e.g., a sol). Preferred colloidal dispersions of vanadium oxide useful in preparing the coated abrasive article according to the present invention are disclosed in assignee's copending patent application, U.S. Ser. No. 07/893,504 filed the same date as this application the disclosure of which is incorporated herein by reference. The colloidal vanadium oxide dispersions preferably are formed by hydrolysis and condensation reactions of vanadium oxide alkoxides.

Sulfopolymers useful in preparing the coated abrasive article according the present invention include those disclosed in assignee's copending patent application, U.S. Ser. No. 07/893,279, filed the same date as this application the disclosure of which is incorporated herein by reference.

The coated abrasive article may be in any conventional form including those having an abrasive layer comprising a make layer, abrasive grains, a size layer, etc., and other functional layers (e.g., a supersize layer), and those having a monolayer as an abrasive layer comprising a slurry layer comprising a bond system and abrasive grain, and other functional layers. The backing of the coated abrasive optionally has a presize coating, a backsize coating, a saturant, or combinations thereof.

Use of vanadium oxide to provide antistatic properties to a coated abrasive article offer several advantages over other such means. For example, the effectiveness of hygroscopic salts as an antistat is dependent on the presence of water. By contrast, vanadium oxide is an effective antistatic even at low humidities.

DETAILED DESCRIPTION OF PREFERRED EMBODIMENTS

This invention pertains to a coated abrasive article which is made electrically conductive by incorporating a vanadium oxide therein.

In general, the coated abrasive product of the present invention comprises a backing which has a front surface and a back surface, and an abrasive layer which comprises a plurality of abrasive grains which are secured to the backing by a bond system. Optionally, the abrasive layer may further comprise other functional layers (e.g., a supersize layer).

With the exception of the vanadium oxide or vanadium oxide and compatible binder, the inventive coated abrasive articles can be prepared using materials and techniques known in the art for constructing coated abrasive articles.

Backing materials forming the coated abrasives of the present invention may be selected from any materials which are known for such use including, for example, paper, polymeric film, fiber, cloth, nonwoven, treated versions thereof, or combinations thereof. For a lapping abrasive the preferred backing is a polymeric film, such as, for example, a primed polyester film.

The backing may further comprise at least one of a presize (i.e., a barrier coat overlying the major surface of the backing onto which the abrasive layer is applied), a backsize (i.e., a barrier coat overlying the major surface of the backing opposite the major surface onto which the abrasive layer is applied), and a saturant (i.e., a barrier coat that is coated on all exposed surfaces of the backing). Preferably, the backing comprises a presize. Suitable presize, backsize, or saturant materials are known in the art. Such materials include, for example, resin or polymer latices, neoprene rubber, butylacrylate, styrol, starch, hide glue, and combinations thereof.

The preferred bond system is a resinous or glutinous adhesive. Examples of typical resinous adhesives include phenolic resins, urea-formaldehyde resins, melamine-formaldehyde resin, aminoplast resins, isocyanate resins, polyester resins, epoxy resins, acrylate resins, urethane resins, hide glue, and combinations thereof. The bond system may contain other additives which are well known in the art, such as, for example, grinding aids, plasticizers, fillers, coupling agents, wetting agents, dyes, and pigments.

Preferably, the abrasive grains are selected from such known grains as fused aluminum oxide, heat-treated aluminum oxide, ceramic aluminum oxide, co-fused alumina-zirconia, garnet, silicon carbide, diamond, cubic boron nitride, silicon nitride, boron carbide, silica, ceria, and combinations thereof. The term "abrasive grain" is meant to include abrasive agglomerates shaped as a mass of abrasive grain bonded together by means of a binder material. Examples of such abrasive agglomerates are disclosed in U.S. Pat. Nos. RE 29,808 (Wagner) and 4,652,275 (Bloecher et al.), the disclosures of which are incorporated herein by reference.

The purpose of the supersize coat is to reduce the amount of loading. "Loading" is the term used to describe the filling of spaces between abrasive grains with swarf (the material removed from the workpiece) and the subsequent build-up of that material. For example, during wood sanding, swarf comprised of wood particles becomes lodged in the spaces between abrasive grains, dramatically reducing the cutting ability of the grains. Examples of useful materials which may be used in the supersize coat include the metal salts of fatty acids, urea-formaldehyde, novolak phenolic resins, waxes, mineral oils, and fluorochemicals. The preferred supersize is a metal salt of a fatty acid such as, for example, zinc stearate.

In the first preferred conventional method for preparing a coated abrasive article, a make coat is applied to a major surface of the electrically conductive backing followed by projecting a plurality of abrasive grains into the make coat. The make coat can be applied to the backing using conventional techniques such as roll coating, curtain coating, die coating, spray coating, or transfer coating. It is preferable in preparing the coated abrasive that the abrasive grains be electrostatically coated. The make coating is cured in a manner sufficient to at least partially solidify it such that a size coat can be applied over the abrasive grains. Next, the size coat is applied over the abrasive grains and the make coat. The size coat can be applied to the make coat and abrasive grain using conventional techniques such as roll coating, curtain coating, or spray coating. Finally, the make and size coats are fully cured. Optionally, a supersize coat can be applied over the size coat and cured. The supersize coat can be applied to the size coat using conventional techniques such as roll coating, curtain coating, or spray coating.

In the second preferred conventional method for preparing a coated abrasive article, a slurry containing abrasive grains dispersed in a bond material is applied to a major surface of the backing. The bond material is then cured. Optionally, a supersize coat can be applied over the slurry coat and cured.

In the above methods, the make coat and size coat or slurry coat can be solidified or cured by means known in the art, including heat or radiation energy.

Preferred colloidal dispersions of vanadium oxide useful in making the coated abrasive article according to the present invention can be prepared as disclosed in U.S. Pat. No. 4,203,769 (Guestaux), and the aforementioned U.S. Ser. No. 07/893,504, the disclosures of which are incorporated herein by reference. The vanadium oxide colloidal dispersions of these two references are similar except the $V^{4+}$ concentrations of the latter are higher and can be controlled. Other advantages of the latter include energy savings, convenience, elimination of conditions whereby highly toxic vanadium-containing fumes may be generated, no need to filter resultant colloidal dispersions, and ability to prepare colloidal dispersions in situ (in aqueous polymer solutions, e.g., sulfonated polymer solutions).

The most preferred vanadium oxide sols, i.e., colloidal dispersions, useful in the present invention, are prepared by hydrolyzing vanadium oxoalkoxides with a molar excess of deionized water. By a "molar excess" of water, it is meant that a sufficient amount of water is present relative to the amount of vanadium oxoalkoxide such that there is greater than a 1:1 molar ratio of water to vanadium-bound alkoxide ligands. Preferably, a sufficient amount of water is used such that the final colloidal dispersion formed contains an effective amount of vanadium that does not exceed about 3.5 percent by weight. This typically requires a molar ratio of water to vanadium alkoxide of at least about 45:1, and preferably at least about 150:1. By an "effective amount" of vanadium it is meant that the colloidal dispersion contains an amount of vanadium in the form of vanadium oxide, whether diluted or not, which is suitable to make a coated abrasive article according to the present invention.

Preferably, the vanadium oxoalkoxides are prepared in situ from a vanadium oxide precursor species and an alcohol. The vanadium oxide precursor species is preferably a vanadium oxyhalide or vanadium oxyacetate. If the vanadium oxoalkoxide is prepared in situ, the vanadium oxoalkoxide may include other ligands such as acetate groups.

Preferably, the vanadium oxoalkoxide is a trialkoxide of the formula $VO(OR)_3$, wherein each R is independently an aliphatic, aryl, heterocyclic, or arylalkyl group. Preferably, each R is independently selected from the group consisting of $C_{1-10}$ alkyls, $C_{1-10}$ alkenyls, $C_{1-10}$ alkynyls, $C_{1-18}$ aryls, $C_{1-18}$ arylalkyls, or mixtures thereof, which can be substituted or unsubstituted. More preferably, each R is independently an unsubstituted $C_{1-6}$ alkyl.

The aliphatic, aryl, heterocyclic, and arylalkyl groups can be unsubstituted, or they can be substituted with various groups such as Br, Cl, F, I, OH groups, or other groups which do not interfere with the polymerization of the binder(s) of the coated abrasive article.

The hydrolysis process results in condensation of the vanadium oxoalkoxides to vanadium oxide colloidal dispersions. The preferred solvent is deionized water or a mixture of deionized water and a water-miscible organic solvent. It can be carried out within a temperature range in which the solvent is in a liquid form. The process is preferably and advantageously carried out at a temperature in the range from about 0° to about 100° C., and more preferably in the range from about 20° to about 30° C. (i.e., at about room temperature).

Preferably, the deionized water or mixture of deionized water contains an effective amount of a hydroperoxide (e.g., $H_2O_2$); or the deionized water and hydroperoxide are combined with a water-miscible organic solvent (e.g., a low molecular weight ketone or an alcohol). Properties of the colloidal vanadium oxide dispersion such as color, size of particles in the dispersion, concentration of $V^{4+}$ ions, and degree of gelation can be modified by the addition of co-reagents, addition of metal dopants, subsequent aging or heat treatments, and removal of alcohol by-products.

Alternatively, the vanadium oxoalkoxides can be prepared in situ from a vanadium oxide precursor species and an alcohol. For example, the vanadium oxoalkoxides can be generated in the reaction flask in which the hydrolysis, and subsequent condensation, reactions occur. That is, the vanadium oxoalkoxides can be generated by combining a vanadium oxide precursor species. Preferred vanadium oxide precursors include a vanadium oxyhalide ($VOX_3$) (e.g., $VOCl_3$), or a vanadium oxyacetate ($VO_2OAc$), with an appropriate alcohol (e.g., i-BuOH, i-PrOH, n-PrOH, n-BuOH, and t-BuOH, wherein Bu=butyl and Pr=propyl). It is understood that if vanadium oxoalkoxides are generated in situ, they may be mixed alkoxides. For example, the product of the in situ reaction of vanadium oxyacetate with an alcohol is a mixed alkoxide/acetate. Thus, herein the term "vanadium oxoalkoxide" is used to refer to species that have at least one alkoxide (—OR) group, particularly if prepared in situ. Preferably, however, the vanadium oxoalkoxides are trialkoxides with three alkoxide groups.

The in situ preparations of the vanadium oxoalkoxides are preferably carried out under an inert atmosphere (e.g., nitrogen or argon). The vanadium oxide precursor species is typically added to an appropriate alcohol at room temperature. For an exothermic reaction, it is preferable to add the vanadium oxide precursor at a controlled rate such that the reaction mixture temperature does not greatly exceed room temperature. Alternatively, the temperature of the reaction mixture can be controlled by placing the reaction flask in a constant temperature bath (e.g., an ice water bath). The reaction of the vanadium oxide species and the alcohol can be done in the presence of an oxirane, such as propylene oxide, ethylene oxide, or epichlorohydrin. The oxirane is effective at removing by-products of the reaction of the vanadium oxide species, particularly vanadium dioxide acetate and vanadium oxyhalides, with alcohols. If desired, volatile starting materials and reaction products can be removed through distillation or evaporative techniques, such as rotary evaporation. The resultant vanadium oxoalkoxide product, whether in the form of a solution or a solid residue after the use of distillation or evaporative techniques, can be added directly to water to produce the vanadium oxide colloidal dispersions of the present invention.

In preparing the preferred vanadium oxide colloidal dispersion, a sufficient amount of water is used such that the colloidal dispersion formed contains vanadium in the range from about 0.05 to about 3.5 percent by weight, based on the total weight of the dispersion, and most preferably in the range from about 0.6 to about 1.7 percent by weight.

In the preferred processes for making the colloidal vanadium oxide dispersion, the vanadium oxoalkoxides are hydrolyzed by adding the vanadium oxoalkoxides to the water, as opposed to adding the water to the vanadium oxoalkoxides. That is advantageous because it typically results in the formation of a desirable colloidal dispersion and generally avoids excessive gelling.

So long as there is a molar excess of water used in the hydrolysis and subsequent condensation reactions of the vanadium oxoalkoxides, water-miscible organic solvents can also be present. In other words, the vanadium oxoalkoxides can be added to a mixture of water and a water-miscible organic solvent. Miscible organic solvents include alcohols, low molecular weight ketones, dioxane, and solvents with a high dielectric constant (e.g., acetonitrile, dimethylformamide, and dimethylsulfoxide). Preferably, the organic solvent is acetone or an alcohol (e.g., i-BuOH, i-PrOH, n-PrOH, n-BuOH, and t-BuOH).

Preferably, the reaction mixture contains an effective amount of hydroperoxide (e.g., $H_2O_2$ or t-butyl hydrogen peroxide). An "effective amount" of a hydroperoxide is an amount that positively or favorably effects the formation of a colloidal dispersion capable of producing an antistatic coating. The presence of the hydroperoxide appears to improve the dispersive characteristics of the colloidal dispersion by facilitating production of an antistatic coating with highly desirable properties. In other words, when an effective amount of hydroperoxide is used the resultant colloidal dispersions tend to be less turbid, and more well dispersed. The hydroperoxide is preferably present in an amount such that the molar ratio of vanadium oxoalkoxide to hydroperoxide is within a range of about 1:1 to 4:1.

Other methods known for the preparation of colloidal vanadium oxide dispersions, which are less preferred, include inorganic methods such as ion exchange acidification of $NaVO_3$, thermohydrolysis of $VOCl_3$, and reaction of $V_2O_5$ with $H_2O_2$.

The colloidal vanadium oxide dispersions may be coated onto a major surface of a coated abrasive article, or be incorporated into the interior of a coated abrasive article, for example, by being coated onto the front surface of the backing prior to the application of a presize layer or saturant, by being coated onto the front surface of the backing prior to the application of the abrasive layer, by being coated onto the top surface of a make layer, size larger, slurry layer, and/or supersize layer prior to the application a subsequent layer, or by being mixed with a backsize, presize, saturant, make, size, slurry, supersize, or other layer precursor, with the proviso that the contact of the colloidal vanadium oxide dispersion with the backsize, presize, saturant, make, size, slurry, supersize, or other layer precursor does not substantially adversely affect the coatability of the dispersion or antistatic properties imparted by the colloidal vanadium oxide. An example of a compatible binder that also serves as of a presize, backsize, saturant, bond system or other layer precursor is a water-based epoxy. A preferred water-based epoxy is disclosed in copending application entitled "Coated Abrasive Having an Overcoating of an Epoxy Resin Coatable From Water," U.S. Ser. No. 07/804,968, filed Dec. 11, 1991, the disclosure of which is incorporated herein by reference, which is a continuation-in-part of U.S. Ser. No. 07/610,701, filed Nov. 14, 1990, (Lee et al.). Preferably, the water-based epoxy is prepared using deionized water.

For a coated abrasive article, the colloidal vanadium oxide dispersion is preferably coated onto at least one of the back surface and the top surface of a coated abrasive article. Most preferably, the colloidal vanadium oxide dispersion is coated onto the back surface of a coated abrasive article. For a three-dimensional, low density abrasive article the colloidal vanadium oxide dispersion is preferably coated onto the outer surface of abrasive article.

The vanadium oxide can also be incorporated into the backing of a coated abrasive article, for example, by using the techniques disclosed in assignee's copending patent application, U.S. Ser. No. 07/834,618 (Schnabel et al.), filed Feb. 12, 1992, the disclosure of which is incorporated herein by reference.

A suitable colloidal vanadium oxide dispersion can be coated onto a surface of a coated abrasive article using conventional coating techniques such as roll coating, die coating, spray coating, dip coating, and curtain coating. A suitable colloidal vanadium oxide dispersion can be coated onto a surface of a three-dimensional, low density abrasive product using conventional coating techniques such as spray coating or dip coating. The coated dispersion can be cured by conventional means including heat or radiation energy. The resulting vanadium oxide coating typically comprises a continuous network of vanadium oxide fibrils.

Preferably, the coating weight of vanadium (calculated in mg of vanadium per $m^2$ of substrate surface area) is up to about 200 $mg/m^2$. More preferably, the coating weight of vanadium in the range from about 3 to about 200 $mg/m^2$, and most preferably, in the range from about 10 to about 50 $mg/m^2$. Coating weights of vanadium in excess of about 200 $mg/m^2$ are typically not economically advantageous.

The surface concentration of vanadium in the vanadium oxide can be calculated from formulation data, assuming 100% conversion of the vanadium oxoalkoxide to the vanadium oxide colloidal dispersion, and also assuming the density of each successively diluted vanadium oxide colloidal dispersion is that of water (i.e., 1 g/ml), and the wet coating thickness, when applied using conventional bar coater with a No. 3 Mayer bar, is about 6.9 micrometers.

Typically, an abrasive article according to the present invention comprises in the range from about 5 to about 1000 $mg/m^2$ vanadium oxide, and preferably in the range from about 5 to about 100 $mg/m^2$ vanadium oxide.

Preferably, an abrasive article according to the present invention further comprises a "compatible binder" in contact with the vanadium oxide. The compatible binder can be present as a separate layer that aids in securing the vanadium oxide to the abrasive article (e.g., the compatible binder can be coated over a layer comprising the vanadium oxide) or it can have the vanadium oxide dispersed within. The most preferred compatible binder is a sulfopolymer.

A wide variety of sulfopolymers are useful as the compatible binder. Preferred sulfopolymers include sulfopolyesters, ethylenically-unsaturated sulfopolymers, sulfopolyurethanes, sulfopolyurethane/polyureas, sulfopolyester polyols, and sulfopolyols. Such sulfopolymers and methods of making the same are disclosed, for example, in U.S. Pat. Nos. 4,052,368 (Larson), 4,307,219 (Larson), 4,330,588 (Larson et al.), 4,558,149 (Larson), 4,738,992 (Larson et al.), 4,746,717 (Larson), and 4,855,384 (Larson), the disclosures of which are incorporated herein by reference.

Useful commercially available sulfonate-containing polymers include poly(sodiumstyrenesulfonate) (commercially available, for example, from Polyscience, Inc. of Warrington, Pa.), and alkylene oxide-co-sulfonate-containing polyester (commercially available, for example, under the trade designation "AQ RESINS" from Eastman Kodak Co. of Kingsport, Tenn.).

Sulfopolyols, including sulfopolyether polyols or sulfopolyester polyols, are known in the literature for a variety of applications, primarily as precursors to other types of sulfopolymers such as sulfopolyurethanes or sulfonate containing radiation curable materials. Preparation of these sulfopolyols is disclosed, for example, in U.S. Pat. Nos. 4,503,198 (Miyai et al.), 4,558,149 (Larson), and 4,738,992 (Larson et al.), the disclosures of which are incorporated herein by reference. These polyols acceptable for use in the present invention may generally be described by the formula taken from U.S. Pat. No. 4,738,992 (Larson et al.):

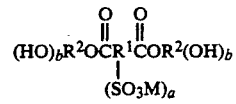

where a is an integer of 1, 2, or 3;

b is an integer of 1, 2, or 3;

M can be a cation selected from alkali metal cation such as sodium, potassium, or lithium; or suitable tertiary, and quaternary ammonium cations having 0 to 18 carbon atoms, such as ammonium, hydrazonium, N-methyl pyridinium, methylammonium, butylammonium, diethylammonium, triethylammonium, tetraethylammonium, and benzyltrimethylammonium;

$R^1$ can be an arenepolyyl group (polyvalent arene group) having a valence of (a+2) and having 6 to 12 carbon atoms or an alkanepolyyl group (polyvalent alkane) having 2 to 20 carbon atoms remaining after the removal of two carboxyl groups and "a" sulfo groups from suitable sulfoarene and sulfoalkane dicarboxylic acids; the group being incorporated into the sulfopolyurethane backbone by the selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanedioic acid; and sulfoarenedicarboxylic acids such as 5-sulfoisophthalic acid, 2-sulfoterephthalic acid, 5-sulfonapthalene-1,4-dicarboxylic acid; sulfobenzylmalonic acid esters such as those described in U.S. Pat. No. 3,821,281 (Radlmann et al.), the disclosure of which is incorporated herein by reference; sulfophenoxymalonate such as described in U.S. Pat. No. 3,624,034 (Price et al.), the disclosure of which is incorporated herein by reference; and sulfofluorenedicarboxylic acids such as 9,9-di-(2'-carboxyethyl)-fluorene-2-sulfonic acid, it being understood that the corresponding lower alkyl carboxylic esters of 4 to 12 carbon atoms, halides, anhydrides, and sulfo salts of the above sulfonic acids can also be used; and $R^2$ is an independently selected linear or branched organic group having a valence of (b+1) that is the residue of an aliphatic or aromatic polyether or polyester polyol.

Polyols (aliphatic or aromatic polyols) useful in preparation of the sulfocompounds have a molecular weight of 62 up to about 2000 and include, for example, monomeric and polymeric polyols having two to four hydroxyl groups. Examples of the monomeric polyols include ethylene glycol, propylene glycol, butylene glycol, hexamethylene glycol, cyclohexamethylenediol, and 1,1,1-trimethylolpropane. Examples of polymeric polyols include polyoxyalkylene polyols (i.e., the diols, triols, and tetrols), polyester diols, triols, and tetrols of organic dicarboxylic acids and polyhydric alcohols, and the polylactone diols, triols, and tetrols having a molecular weight of 106 to about 2000. Examples of polymeric polyols include polyoxyethylene diols, triols, and tetrols (including those commercially available under the trade designation "CARBOWAX POLYOLS" from Union Carbide, Danbury, Conn.), polyester polyols (including poly(ethyleneadipate) polyols commercially available under the trade designation "MULTRON" from Mobay Chemical Company of Pittsbugh, Pa.), and polycaprolactone polyols (including those commercially available under the trade designation "PCP POLYOLS" from Union Carbide of Danbury, Conn.). Examples of aromatic polyols include polyester polyols prepared from aromatic dicarboxylic acids (e.g., phthalic acids) and excess diols (e.g., diethylene glycol and triethylene glycol); and from dicarboyxlic acids (e.g., adipic acid and resorcinol). The polymeric polyols that have a molecular weight of about 300 to 1000 are preferred.

The sulfopolyol is generally obtained by the esterification reaction of the sulfo-substituted dicarboxylic acid derivative with the polyols described above. Examples of typical esterification conditions are disclosed in the Examples of U.S. Pat. No. 4,558,149 (Larson), the disclosure of which is incorporated herein by reference.

Alternatively, sulfopolyols may be produced according to the method disclosed in U.S. Pat. No. 4,503,198 (Miyai et al.), the disclosure of which is incorporated herein by reference, wherein non-symmetric sulfopolyols are obtained by the reaction of sulfonate containing dicarboxylic acids such as those described above, with a carboxylic acid component such as aromatic dicarboxylic acids including terephthalic acid or 1,5-naphthalic acid, or aliphatic dicarboxylic acids such as adipic or sebacic acid, etc; and polyhydric alcohols such as aliphatic diols including ethylene glycol, propylene glycol, and 1,6-hexanediol.

Sulfopolyols with glass transition temperatures above room temperature (e.g., Tg greater than 25° C. as measured by differential scanning calorimetry) are useful for obtaining non-tacky coatings on various substrates.

Water dispersible sulfopolyesters are known in the literature and are utilized for a wide variety of applications including primers, size coats, subbing for photographic emulsions, hydrophilic coatings for stain release, lithographic binders, hair grooming, and adhesives. In some instances, these sulfopolyesters are dispersed in water in conjunction with an emulsifying agent and high shear to yield a stable emulsion; sulfopolyesters may also be completely water soluble. Additionally, stable dispersions may be produced in instances where sulfopolyesters are initially dissolved in a mixture of water and an organic cosolvent, with subsequent removal of the cosolvent yielding an aqueous sulfopolyester dispersion.

Sulfopolyesters disclosed in U.S. Pat. Nos. 3,734,874 (Kibler et al.), 3,779,993 (Kibler et al.), 4,052,368 (Larson), 4,104,262 (Schade), 4,304,901 (O'Neill et al.), 4,330,588 (Larson et al.), the disclosures of which are incorporated herein by reference, for example, relate to low melting (below 100° C.) or non-crystalline sulfopolyesters which may be dispersed in water according to these methods. In general, sulfopolyesters of this type may be best described by the following formula:

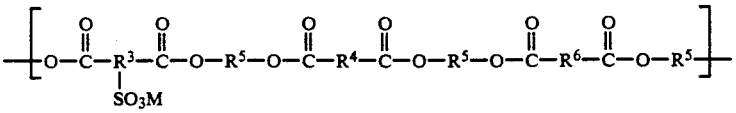

where

M can be an alkali metal cation such as sodium, potassium, or lithium; or suitable tertiary, and quaternary ammonium cations having 0 to 18 carbon atoms, such as ammonium, hydrazonium, N-methyl pyridinium, methylammonium, butylammonium, diethylammonium, triethylammonium, tetraethylammonium, and benzyltrimethylammonium;

$R^3$ can be an arylene or aliphatic group incorporated in the sulfopolyester by selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanedioic acid; and sulfoarenedicarboxylic acids such as 5-sulfoisophthalic acid, 2-sulfoterephthalic acid, 5-sulfonapthalene-1,4-dicarboxylic acid; sulfobenzylmalonic acid esters such as those described in U.S. Pat. No. 3,821,281 (Radlmann et al.), the disclosure of which is incorporated herein by reference; sulfophenoxymalonate such as described in U.S. Pat. No. 3,624,034 (Price et al.), the disclosure of which is incorporated herein by reference, and sulfofluorenedicarboxylic acids such as 9,9-di-(2'-carboxyethyl)-fluorene-2-sulfonic acid, it being understood that the corresponding lower alkyl carboxylic esters of 4 to 12 carbon atoms, halides, anhydrides, and sulfo salts of the above sulfonic acids can also be used;

$R^4$ can be optionally incorporated in the sulfopolyester by the selection of one or more suitable arylenedicarboxylic acids, or corresponding acid chlorides, anhydrides, or lower alkyl carboxylic esters of 4 to 12 carbon atoms, suitable acids include the phthalic acids (orthophthalic, terephthalic, isophthalic), 5-t-butyl isophthalic acid, naphthalic acids (e.g., 1,4- or 2,5-napthalene dicarboxylic), diphenic acid, oxydibenzoic acid, and anthracene dicarboxylic acids, suitable esters or anhydrides include dimethyl isophthalate or dibutyl terephthalate, and phthalic anhydride;

$R^5$ can be incorporated in the sulfopolyester by the selection of one or more suitable diols including straight or branched chain alkylenediols having the formula $HO(CH_2)_cOH$ in which c is an integer of 2 to 12 and oxaalkylenediols having a formula $H-(OR^5)_d-OH$ in which $R^5$ is an alkylene group having 2 to 4 carbon atoms and d is an integer of 1 to 6, the values being such that there are no more than 10 carbon atoms in the oxaalkylenediol, suitable diols include ethyleneglycol, propylene- glycol, 1,5-pentanediol, 1,6-hexanediol, 1,8-octanediol, 1,10-decanediol, 2,2-dimethyl-1,3-propanediol, 2,2-diethyl-1,3-propanediol, 3-methyl-1,5-pentanediol, diethylene-glycol, dipropyleneglycol, and diisopropyleneglycol, suitable cycloaliphatic diols include 1,4-cyclohexanedimethanol and 1,3-cyclohexanedimethanol, suitable polyester or polyether polyols include polycaprolactone, polyneopentyl adipate, and polyethyleneoxide diols up to 4000 in molecular weight; generally these polyols are used in conjunction with lower molecular weight diols such as ethylene glycol if high molecular weight polyesters are desired; and $R^6$ can be incorporated in the sulfopolyester by the selection of suitable aliphatic or cycloaliphatic dicarboxylic acids or corresponding acid chlorides, anhydrides or ester derivatives; such as acids having the formula $HOOC(CH_2)_cCOOH$, wherein e is an integer having an average value of 2 to 8, e.g., succinic acid, adipic acid, maleic acid, glutaric acid, suberic acid, and sebacic acid, suitable cycloaliphatic acids include cyclohexane 1,4-dicarboxylic acid.

The sulfopolyesters which are useful in the practice of this invention can be prepared by standard techniques, typically involving the reaction of dicarboxylic acids (or diesters, anhydrides, etc. thereof) with monoalkylene glycols and/or polyols in the presence of acid or metal catalysts (e.g., antimony trioxide, zinc acetate, p-toluene sulfonic acid, etc.), utilizing heat and pressure as desired. Normally, an excess of the glycol is supplied and removed by conventional techniques in the later stages of polymerization. When desired, a hindered phenol antioxidant may be added to the reaction mixture to protect the polyester from oxidation. To ensure that the ultimate polymer will contain more than 90 mole % of the residue of monoalkylene glycols and/or polyols, a small amount of a buffering agent (e.g. sodium acetate, potassium acetate, etc.) is added. While the exact reaction mechanism is not known with certainty, it is thought that the sulfonated aromatic dicarboxylic acid promotes the undesired polymerization of the glycol per se and that this side reaction is inhibited by a buffering agent.

Water dispersible sulfopolyurethanes or sulfopolyurethane/ureas are known in the literature and are widely utilized, for example, as textile and paper coatings, binders for nonwoven webs, adhesives, size coats for glass and fiber, and abrasion resistant coatings. Sulfopolyurethanes may be synthesized by a wide variety of methods. In general, one major class of linear sulfopolyurethanes as are disclosed in U.S. Pat. No. 4,307,219 (Larson), the disclosure of which is incorporated herein by reference, may be best described by the following formula:

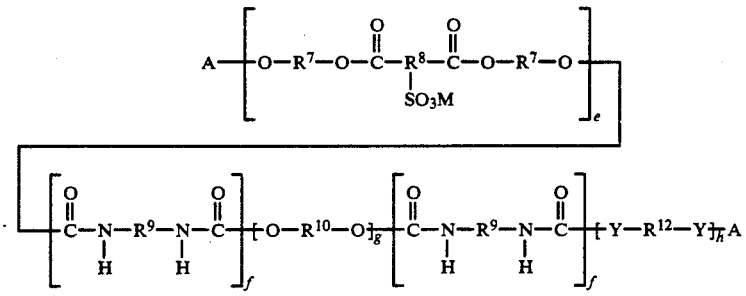

where e, f, g, and h can be numbers expressing the mole ratios of polyurethane hydrophilic, connecting, hydrophobic and chain extending segments within the respective parentheses in which e is 1, g is 0.1 to 20, h is 0 to 20, and f is (e+g+h), the values of e, f, g, and h being chosen with regard to the subsequent molecules selected in the construction of the sulfopolyurethane such that there is one sulfonate group per about 1000 to 8000 molecular weight of the sulfopolyurethane;

each A can be independently selected from monovalent terminal groups;

M can be a cation as defined above;

$R^7$ can be the residue remaining after removal of terminal hydroxyl groups from one or more diols, $HO\text{-}R^7\text{-}OH$, said diols having a number average molecular weight between about 150 and 3500, suitable diols being selected from polyoxyalkylene diols, polyester diols, and polylactone diols such as polycaprolactone or polyethyleneoxide diols of 150 to 3500 weight average molecular weight;

$R^8$ can be an arenetriyl group having 6 to 12 carbon atoms or an alkanetriyl group having 2 to 12 carbon atoms, said group being incorporated into the sulfopolyurethane backbone by the selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanedioic acid; and sulfoarenedicarboxylic acids such as 5-sulfoisophthalic acid, 2-sulfoterephthalic acid, 5-sulfonapthalene-1,4-dicarboxylic acid; sulfobenzylmalonic acid esters such as those described in U.S. Pat. No. 3,821,281 (Radlmann et al.), the disclosure of which is incorporated herein by reference, sulfophenoxymalonate such as described in U.S. Pat. No. 3,624,034 (Price et al.), the disclosure of which is incorporated herein by reference; and sulfofluorenedicarboxylic acids such as 9,9-di-(2'-carboxyethyl)-fluorene-2-sulfonic acid, it being understood that the corresponding lower alkyl carboxylic esters of 4 to 12 carbon atoms, halides, anhydrides, and sulfo salts of the above sulfonic acids can also be used;

$R^9$ is the residue remaining after removal of -NCO groups from polyisocyanates, $OCN\text{—}R^9\text{—}NCO$, in which $R^9$ is arylene or alkylarylene having 6 to 12 carbon atoms, cycloalkylene having 5 to 12 carbon atoms, or divalent 5 or 6 atom containing azacyclic groups having 3 to 10 carbon atoms and 1 to 3 -NCO groups, suitable diisocyanates for use as the connecting segment include any of the aliphatic, aromatic, and heterocyclic diisocyanates known in the polyurethane field, preferred diisocyanates include 2,4-tolylene diisocyanate; 3,5,5-trimethyl-1-isocyanato-3-isocyanato-methylcyclohexane, methylene bis-(4-cyclohexylisocyanate), and 4,4'-diisocyanato diphenyl methane;

$R^{10}$ is the residue remaining after removal of hydroxyl groups from one or more hydrophobic diols, HO—$R^{10}$—OH, having a weight average molecular weight of about 400 to 4000. Suitable hydrophobic diols can be derived from the same generic families of diols HO—$R^7$—OH with exclusion of polyoxyethyleneglycols, suitable hydrophobic diols having a number average molecular weight of about 400 to 4000, and preferably from about 500 to 2000, because with decreasing molecular weights of the hydrophobic diol, the influence of the hydrophilic segment increases so that at molecular weights below 400, the polyurethanes become water soluble, and with increasing molecular weights, the influence of the hydrophilic segment decreases so that as molecular weights of the hydrophobic diol are increased above about 4000, the polyurethane becomes less and less dispersible in aqueous organic solvents;

Y can be —O—, —S—, or —N($R^{11}$)— in which $R^{11}$ is hydrogen or lower alkyl of from 1 to 4 carbon atoms; and $R^{12}$ can be the residue remaining after the removal of terminal active hydrogen containing groups from chain extender compounds having two Zerewitinoff hydrogen atoms reactive with isocyanate groups and having a weight average molecular weight of from about 18 to about 200, suitable chain extenders include any compound having two active hydrogen containing groups, and a molecular weight between 18 and about 200, suitable compounds include water, diols, amines, bis(monoalkylamine) compounds, dihydrazides, dithiols, and N-alkylaminoalkanols. Preferred chain extenders are the diols having the formula $HO(CH_2)_iOH$ in which i is an integer of 2 to 12; glycols of the formula $HO(—CH_2O—)_j—H$, in which j is an integer of 1 to 6; glycols of the formula $$HO—(CH(CH_3)CH_2O—)_k—H,$$

in which k is an integer of 1 to 4, e.g. ethylene glycol, propylene glycol, diethylene glycol, diisopropylene glycol, and the like, and 2,2-dimethyl-1,3-propanediol, 1,4-cyclohexanediol, and 1,4-(dihydroxymethyl)cyclohexane.

Suitable sulfopolyurethanes can be prepared by standard techniques beginning with the preparation of the hydrophilic diol from the diesterification reaction of the $R^8$ containing sulfoacid and the $R^7$ group containing diol as described above. The aqueous dispersible sulfopolyurethanes are then prepared by the coreaction of the diisocyanate with the hydrophilic diol, hydrophobic diol, and where used, chain-extenders under essentially anhydrous conditions in an organic solvent such as methyl ethyl ketone or tetrahydrofuran, as described in U.S. Pat. No. 4,307,219 (Larson), the disclosure of which is incorporated herein by reference.

Other representative methods for making sulfopolyurethane dispersions are disclosed in a review article "Aqueous Dispersions of Crosslinked Polyurethanes" (R. E. Tirpak and P. H. Markusch; *Journal of Water Borne Coatings*, November 1986, pp.12–22), and U.S. Pat. Nos. 3,998,870 (Larson), 4,307,219 (Larson), and 4,408,008 (Markusch), the disclosures of which are incorporated herein by reference. Methods of preparing sulfonate containing polyurethane dispersions described in these references include the use of sulfonate containing polyethyleneoxide monoalcohols, sulfonate containing diamines, low molecular weight sulfonic acid containing diols which are the reaction product of sodium bisulfite and alkene containing diols, and sulfonic acid containing isocyanates in conjunction with diols, di- or tri-amines, and diisocyanates as described above. The general method of preparation varies according to the sulfonated molecule used as taught in the references cited above.

Water dispersible ethylenically unsaturated sulfocompounds are known in the literature, for example U.S. Pat. Nos. 4,503,198 (Miyai et al.), 4,558,149 (Larson), 4,746,717 (Larson), and 4,855,384 (Larson), the disclosures of which are incorporated herein by reference. An important class of these sulfocompounds which are disclosed in the above references may be best described by the following formula:

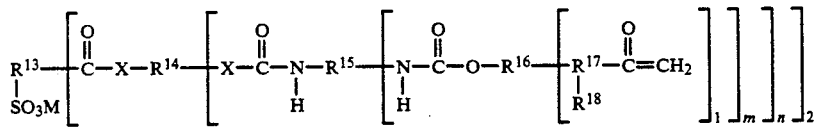

where l is an integer of 1, 2, or 3;

m is an integer of 1, 2, or 3;

n is an integer of 1, 2, or 3;

M can be a cation as defined above;

$R^{13}$ is an arenetriyl group having 6 to 20 carbon atoms or an alkanetriyl group having 2 to 12 carbon atoms, the group being incorporated into the sulfopolyurethane backbone by the selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanedioic acid; and sulfoarenedicarboxylic acids such as 5-sulfoisophthalic acid, 2-sulfoterephthalic acid, 5-sulfonapthalene-1,4-dicarboxylic acid; sulfobenzylmalonic acid esters such as those described in U.S. Pat. No. 3,821,281 (Radlmann et al.), the disclosure of which is incorporated herein by reference; sulfophenoxymalonate such as described in U.S. Pat. No. 3,624,034 (Price et al.), the disclosure of which is incorporated herein by reference; and sulfofluorenedicarboxylic acids such as 9,9-di-(2'-carboxyethyl)-fluorene-2-sulfonic acid, it being understood that the corresponding lower alkyl carboxylic esters of 4 to 12 carbon atoms, halides, anhydrides, and sulfo salts of the above sulfonic acids can also be used;

X can be independently —O— or —NH—; and $R^{14}$ is a linear aliphatic group having a valence of (v+1), wherein v can be 1, 2, or 3, that is the residue remaining after removal of terminal hydroxyl or amine groups from one or more polyether or polyester polyols or polyamines, having a number average molecular weight of up to 2000, suitable diols being selected from polyoxyalkylene diols, polyester diols, and polylactone diols such as polycaprolactone or polyethyleneoxide diols of 150 to 3500 molecular weight, suitable aliphatic polyols having a molecular weight of 62 to 1000 include ethylene glycol and propylene glycol; and polymeric polyols of 106 to 2000 in molecular weight such as polyethyleneoxide diols, triols, and tetrols (including those commercially available under the trade designation "CARBOWAX POLYOLS" from Union Carbide), or polyethylene adipate or polycaprolactone polyols, suitable aliphatic polyamines include polyoxypropylene diamines (such as those commercially available under the trade designation "JEFFAMINE" from Texaco Chemical Co.), or hydrazino compounds such as adipic dihydrazide or ethylene dihydrazine;

$R^{15}$ is the residue from the reaction of suitable isocyanato compounds such as hexamethylene diisocyanate, toluene diisocyanate, isophorone diisocyanate, 3,5,5-trimethyl-1-isocyanto-3-isocyanatomethylcyclohexane, 4,4'-diphenylmethane diisocyanate, and the polymethylpolyphenylisocyanates, mixtures of polyisocyanates can also be used such as the mixture of methyldiisocyanate (MDI) and trifunctional isocyanate (commercially available, for example, from Dow Chemical Company of Midland, Mich. under the trade designation "ISONATE 2143L");

$R^{16}$ is a polyvalent aliphatic group selected from linear and branched alkyl groups having a valence of (l+1), 2 to 12 carbon atoms, that can be interrupted by one nonperoxidic catenary oxygen atom and/or one —C(=O)NH— group and alicyclic groups having a 5- or 6-atom carbocyclic structure optionally substituted by up to 4 lower alkyl groups having 1 to 4 carbon atoms and a total of up to 12 carbon atoms as disclosed in U.S. Pat. No. 4,855,384 (Larson), the disclosure of which is incorporated herein by reference;

$R^{17}$ is —C(=O)O— or —C(=O)NH—; and $R^{18}$ is a hydrogen or methyl group; wherein in conjunction with $R^{16}$, $R^{17}$ and $R^{18}$ are incorporated in the ethylenically substituted sulfocompound by the selection of appropriate ethylenically substituted compounds such as 2-alkenylazlactones (e.g. 2-ethenyl-1,3-oxazolin-5-one), isocyanate substituted ethylenically unsaturated compounds such as 2-isocyanatoethyl methacrylate, or ethylenically unsaturated alcohols such as allyl and methallyl alcohols, 2-hydroxy acrylate and methacrylate, 1,1,1-trimethylolpropane diacrylate, and pentaerythritol triacrylate and methacrylate. Such ethylenically unsaturated compounds can be incorporated into the ethylenically unsaturated sulfocompound depicted above according to procedures described in U.S. Pat. No. 4,855,384 (Larson), the disclosure of which is incorporated herein by reference. In general these compounds may be prepared by the sequential reaction of the sulfopolyol with the isocyanate, followed by reaction with hydroxyl substituted ethylenically unsubstituted compounds under anhydrous conditions; or by reaction of the sulfocompound with appropriate 2-alkenylazlactone or isocyanate substituted acrylate or acrylamido compounds. Other variations are described in U.S. pat. No. 4,855,384 (Larson), the disclosure of which is incorporated herein by reference, or are known and described by those skilled in the art.

A coatable sulfonated polymer composition can be prepared by dispersing the sulfopolymer in water, optionally with water-miscible solvent (generally less than 50 weight percent cosolvent) dispersion can contain more than zero and up to about 50 percent by weight sulfo-containing polymer, preferably in the range of 10 to 25 weight percent sulfo-containing polymer. Organic solvents miscible with water can be added. Examples of such organic solvents that can be used include acetone, methyl ethyl ketone, methanol, ethanol, and other alcohols and ketones. The presence of such solvents is desirable when need exists to alter the coating characteristics of the coating solution.

For ease of coatability, the sulfopolymer/vanadium oxide compositions preferably comprise up to about 15 percent by weight solids, based on the total weight of the composition. More preferably, the compositions comprise up to 10 percent by weight solids, and most preferably up to 6 percent by weight solids. The solids can comprise in the range of about 0.2 to about 80 percent by weight $V_2O_5$ and in the range from about 99.8 to about 20 percent by weight polymer, based on the total weight of the solids. Preferably, the solids can comprise in the range of about 0.2 to about 50 percent by weight $V_2O_5$ and in the range from about 99.8 to about 50 percent by weight polymer, and most preferably, in the range of about 0.5 to about 20 percent by weight $V_2O_5$ and in the range from about 99.5 to about 80 percent by weight polymer. It is to be appreciated that vanadium accounts for about 56 percent of the molecular weight of $V_2O_5$, so weight percent of vanadium can be readily calculated by multiplying weight percent $V_2O_5$ by 0.56.

The vanadium oxide dispersion can be diluted with deionized water to a desired concentration before mixing with the aqueous sulfopolymer dispersions. The use of deionized water avoids problems with flocculation of the colloidal particles in the dispersions. Deionized water has had a significant amount of Ca(2+) and Mg(2+) ions removed. Preferably, the deionized water contains less than about 50 ppm of these multivalent cations, most preferably less than 5 ppm.

The mixing of the sulfopolymer/vanadium oxide dispersion generally involves stirring the two dispersions together for a time sufficient to effect complete mixing. The resulting sulfopolymer/vanadium oxide dispersions are typically brown, thus imparting a yellow or brown tint to the final coating. Depending upon the coating surface, wetting out completely can be difficult, so it is sometimes convenient to alter the coating composition by the addition of organic solvents. It is apparent to those skilled in the art that the addition of various solvents is acceptable, so long as it does not cause flocculation or precipitation of the sulfopolymer or the vanadium oxide.

Alternatively, the vanadium oxide dispersion can be generated in the presence of a sulfopolymer or prepolymer by, for example, the addition of $VO(OiBu)_3$ to a dispersion of polymer, optionally containing hydrogen peroxide, and aging this mixture at 50° C. for several hours to several days. In this way, colloidal vanadium oxide dispersions can be prepared in situ with dispersions with which they might otherwise be incompatible, as evidenced by flocculation of the colloidal dispersion. Alternatively, this method simply may be a more convenient preparation method for some dispersions.

The sulfonated polymer can be cured by conventional means including heat or radiation energy.

The coated abrasive article according to the present invention can be in the shape of conventional coated abrasive articles, for example, belts, discs, sheets, and strips. The most preferred shape is a belt.

The three-dimensional, low density abrasive product is characterized by having a three-dimensional, low density web structure, abrasive grain, and a bond system that serves to secure the abrasive grain to the web structure. Such products typically have a void volume in the range from about 85 to about 95 percent and can be prepared by techniques known in the art, for example, as described in U.S. Pat. No. 2,958,593 (Hoover et al.), the disclosure of which is incorporated herein by reference. Bond systems and abrasive grain useful in preparing a three-dimensional, low density abrasive product include those described above for a coated abrasive article. Other useful abrasive grain include those made of calcium carbonate or pumice.

The incorporation of the vanadium oxide into the abrasive constructions provides certain desirable antistatic properties. Although not wanting to be bound by theory, it is believed that the electrically conductive abrasives according to the present invention rapidly dissipate static electricity generated during the abrading of workpieces.

For coated abrasive constructions, an exhaust system is frequency used during the abrading of a workpiece. When the static electricity is dissipated, the workpiece dust particles generated in the abrading operation are removed by the normal exhaust systems. If the static electricity is not dissipated, the workpiece dust particles carry a charge, and may not be removed as readily by the normal exhaust system.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Example 1

A water soluble sulfonated polyester resin solution, hereafter referred to as "Polymer A Solution," was prepared as follows. A one gallon polyester kettle was charged with 126 g (6.2 mole %) dimethyl 5-sodiosulfoisophthalate (commercially available from E. I. DuPont de Nemours of Wilmington, Del.), 1002.6 g (75 mole %) dimethyl terephthalate (commercially available from Amoco Chemical Co. of Chicago, Ill.), 251.3 g (18.8 mole %) dimethyl isophthalate (commercially available from Amoco Chemical Co.), 854.4 g (200 mole %) ethylene glycol (polyester grade), 365.2 g (10 mole %, 22 weight % in final polyester), polycaprolactone diol (trade designation PCP-0200 TM from Union Carbide, Danbury, Conn.), 0.7 g antimony oxide (commercially available from Fisher Scientific Co. of Fairlawn, N.J.), and 2.5 g sodium acetate (commercially available from Matheson, Coleman and Bell of Norwood, Ohio). The mixture was heated with stirring to 180° C. at 138 kPa (20 psi) under nitrogen, at which time 0.7 g zinc acetate (an esterification catalyst)(commercially available from J. T. Baker Chemical Co. of Phillipsburg, N.J.) was added. Methanol evolution was observed. The temperature was increased to 220° C. and held for 1 hour. The pressure was then reduced, vacuum applied (0.2 torr), and the temperature was increased to 260° C. The viscosity of the material increased over a period of 30 minutes, after which time a high molecular weight, clear, viscous sulfopolyester was drained. This sulfopolyester was found by Differential Scanning Calorimetry (DSC) to have a $T_g$ of 50.1° C. The theoretical sulfonate equivalent weight was 3954 g polymer per mole of sulfonate.

500 g of the polymer was dissolved in a mixture of 2000 g water and 450 g isopropanol at 80° C. The temperature was then increased to 95° C. in order to remove the isopropanol (and a portion of the water), yielding a 22% solids aqueous dispersion of Polymer A.

A vanadium oxide dispersion was prepared by adding about 9.4 grams (33 millimoles) of $VO(Oi\text{-}Bu)_3$ (vanadium triisobutoxide oxide) (commercially available from Akzo Chemicals Inc. of Chicago, Ill.) to about 0.28 gram (8.2 millimoles) of $H_2O_2$ in about 140.3 grams of deionized water. The vanadium oxide sol was stirred overnight at room temperature (i.e., about 25° C.). The resulting sol was aged for six days at about 50° C., and then diluted with an equal amount of deionized water to provide a sol having a $V_2O_5$ equivalent of 1%.

Next, about 137 grams of deionized water, about 75 grams of the 22% solids aqueous dispersion of Polymer A, and about 0.3 gram of a surfactant (commercially available under the trade designation "TRITON X-100" from Rohm & Haas of Philadelphia, Pa.) were added sequentially to about 37.5 grams of the vanadium oxide sol having a $V_2O_5$ equivalent of 1%, prepared above, to provide a coating composition.

Next, the coating composition was coated onto the back surface of grade P120 coated abrasive paper belt (commercially under the trade designation "P120F IMPERIAL RESIN PAPER BOND OPEN COAT" from the 3M Company of St. Paul, Minn.) by hand spreading using a No. 8 Mayer bar. The resulting coated abrasive article was dried at room temperature to incipient dryness and then further dried at about 120° C. for about 15 minutes. The resulting coated abrasive was then conventionally flexed and rehumidified overnight at about 35% humidity to prevent the paper from becoming brittle.

The coated abrasive belt was then installed on an Oakley Model D Single Belt Stroke Sander. The coated abrasive belt abraded three red oak workpieces for seven minutes each. The pressure at the interface was approximately 0.20 Newton/square centimeter. The belt speed corresponded to about 1670 surface meters per minute. The amount of red oak removed (cut) was measured and the amount of dust (swarf) collected on metal plate immediately past the workpiece holder was determined. The amount of red oak removed was divided by the amount of dust collected to generate a dimensionless "Dust Efficiency Factor" (DEF). High values of the DEF indicate that the production of dust uncollected by the exhaust system was low. The results are shown in Table 1 below.

TABLE 1

| Example | Amount of workpiece removed, grams | Amount of dust collected, grams | DEF |
|---|---|---|---|
| 1 | 361 | 13 | 27.8 |
| Comparative A | 384 | 44 | 8.7 |
| Comparative B | 376 | 13 | 28.9 |
| Comparative C | 384 | 20 | 19.2 |

Comparative A

Comparative A was grade P120 coated abrasive paper belt ("P120F IMPERIAL RESIN PAPER BOND OPEN COAT"). This coated abrasive product is not considered to exhibit static resistant properties.

Comparative B

Comparartive B was grade P120 coated abrasive paper belt commercially available under the trade designation "P120 3M 264UZ XODUST" from the 3M Company. This coated abrasive product is considered to exhibit static resistant properties.

Comparative C

Comparative C was grade P120 coated abrasive paper belt commercially available under the trade designation "P120 3M 265UZ XODUST" from the 3M Company. This coated abrasive product is considered to exhibit static resistant properties.

The results of Example 1 and Comparative A show that the incorporation of the vanadium oxide into a coated abrasive article significantly reduced the amount of dust (i.e., swarf) accumulated. Further, the results of Example 1 and Comparatives B and C, the latter of which is considered to exhibit static resistant properties, show that Example 1 provides static reduction results superior to that of Comparative C, and similar to that of Comparative B.

Example 2 and 3

Examples 2 and 3 illustrate the effectiveness of vanadium oxide coatings at reducing the amount of static electric buildup on the backside of a coated abrasive article. A vanadium oxide dispersion having a a $V_2O_5$ equivalent of 1% was prepared as described in Example 1. This vanadium oxide dispersion was applied to the back surface of a grade P120 coated abrasive paper belt ("P120F IMPERIAL RESIN BOND PAPER OPEN COAT") by hand spreading using a No. 8 Mayer bar. The resulting coated abrasive article was dried at room temperature to incipient dryness and then further dried at about 120° C. for about 15 minutes to provide Example 2.

Example 3 was prepared as described for Example 2 except the vanadium oxide dispersion was further diluted with deionized water such that the $V_2O_5$ equivalence was 0.1%.

The static electric decay rates of the backside of Examples 2 and 3, a grade P120 coated abrasive paper belt not considered to to exhibit static resistant properties (hereafter referred to as Comparative D) ("P120F IMPERIAL RESIN BOND PAPER OPEN COAT"), a grade P120 coated abrasive paper belt having an electrically conductive ink coated on the backsurface thereof (hereafter referred to as Comparative E) (commercially available under the trade designation "3M 261 UZ XODUST RESIN BOND PAPER" from the 3M Company) were measured using a conventional static decay meter (Model 406 C STATIC DECAY METER; Electro-Tech Systems, Inc. of Glenside, Pa.). The latter abrasive article is considered to exhibit static resistant properties. The backing of each abrasive article was charged to 5000 volts, the cutoff level of the static decay meter was set at 0%.

The static decay of Examples 2 and 3 were 0.01 second or less. The static decay of Comparatives D and E were 0.3–0.5 second and 0.01 second or less, respectively.

Examples 4 and 5

Example 4

A vanadium oxide colloidal dispersion prepared as described in Example 1 (12 g of a colloidal dispersion containing 1.0% $V_2O_5$) was diluted with 180 g deionized water coating dispersion was applied to the backside of a grade P120 coated abrasive paper belt ("P120F IMPERIAL RESIN PAPER BOND OPEN COAT") and dried at room temperature to incipient dryness and then further dried at about 120° C. for about 15 minutes. Next, a coating solution (Solution I) containing 6% polyester (commercially available under the trade designation ("VITEL POLYESTER" from Goodyear Tire and Rubber Co. of Akron, Ohio), 14% methylethyl ketone, and 80% toluene was applied to the $V_2O_5$ coated backside of the coated abrasive belt using a conventional bar coater with a No. 8 Mayer bar. The belt was dried at room temperature to incipient dryness and then dried further at 120° C. for about 15 minutes. The belt was then conditioned and tested as described in Example 1, except the workpieces were pine. The results are shown in Table 2, below.

Example 5

A vanadium oxide colloidal dispersion prepared as described in Example 1 (50.0 g of a 1% vanadium oxide colloidal dispersion) was diluted with 283.3 g deionized water to give a coating dispersion containing 0.15% $V_2O_5$. The coating dispersion was applied to the front side (i.e., abrasive side) of a grade P120 coated abrasive paper belt ("P120F IMPERIAL RESIN PAPER BOND OPEN COAT") using a rubber squeegee. The belt was dried at room temperature to incipient dryness and then further dried at about 120° C. for 60 minutes.

The belt was overcoated on the front side with Solution I (described in Example 4) using a rubber squeegee. The belt was dried at room temperature to the point of incipient dryness and then further dried at 120° C. for about 15 minutes. The belt was then conditioned and tested as described in Example 1, except the workpieces were pine. The results are shown in Table 2, below.

TABLE 2

| Example | Amount of workpiece removed, grams | Amount of dust collected, grams | DEF |
|---|---|---|---|
| 4 | 877 | 44 | 19.9 |
| 5 | 855 | 61 | 14 |
| Comparative F | 865 | 70 | 12.4 |
| Comparative G | 825 | 28 | 29.5 |
| Comparative H | 864 | 40 | 21.6 |

Comparative F

Comparative F was grade P120 coated abrasive paper belt- ("P120F IMPERIAL RESIN PAPER BOND OPEN COAT"). This coated abrasive product is not considered to exhibit static resistant properties.

Comparative G

Comparative G was grade P120 coated abrasive paper belt ("P120 3M 264UZ XODUST"). This coated abrasive product is considered to exhibit static resistant properties.

Comparative H

Comparative H was grade P120 coated abrasive paper belt ("P120 3M 265UZ XODUST"). This coated abrasive product is considered to exhibit static resistant properties.

The results of Example 4 and Comparative Example F demonstrate the effectiveness of coating vanadium oxide with a polyester overcoat onto the back side of a coated abrasive belt to reduce the amount of dust accumulated during the abrading of a workpiece. The reason for the low performance of Example 5, as compared to Example 4, is not known.

Examples 6 and 7

Examples 6 and 7 demonstrate the compatibility of various bond systems with a colloidal vanadium oxide dispersion/sulfonated polymer mixture.

Example 6

A one gallon polyester kettle was charged with 126 g (6.2 mole %) dimethyl 5-sodiosulfoisophthalate (commercially available from E. I. DuPont de Nemours), 625.5 g (46.8 mole %) dimethyl terephthalate (commercially available from Amoco Chemical Co.), 628.3 g (47.0 mole %) dimethyl isophthalate (commercially available from Amoco Chemical Co.), 854.4 g (200 mole % glycol excess) ethylene glycol (polyester grade), 365.2 g (10 mole %, 22 weight % in final polyester) PCP-0200 TM polycaprolactone diol (commercially available from Union Carbide), 0.7 g antimony oxide (commercially available from Fisher Scientific Co.), and 2.5 g sodium acetate (commercially available from Matheson, Coleman, and Bell). The mixture was heated with stirring to 180° C. at 138 kPa (20 psi) under nitrogen, at which time 0.7 g zinc acetate (commercially available from J. T. Baker Chemical Co.) was added. Methanol evolution was observed. The temperature was increased to 220° C. and held for 1 hour. The pressure was then reduced, vacuum applied (0.2 torr), and the temperature increased to 260° C. The viscosity of the material increased over a period of 30 minutes, after which time a high molecular weight, clear, viscous sulfopolyester was drained. This sulfopolyester was found by DSC to have a $T_g$ of 41.9° C. The theoretical sulfonate equivalent weight was 3954 g polymer per mole of sulfonate. 500 g of the polymer were dissolved in a mixture of 2000 g water and 450 g isopropanol at 80° C. The temperature was then raised to 95° C. in order to remove the isopropanol (and a portion of the water), yielding a 21% solids aqueous dispersion (hereafter referred to as "Polymer B Dispersion").

A vanadium oxide dispersion was prepared by adding about 9.4 grams (33 millimoles) of $VO(Oi\text{-}Bu)_3$ (vanadium triisobutoxide oxide) (commercially available from Akzo Chemicals Inc.) to about 0.28 gram (8.2 millimoles) of $H_2O_2$ in about 140.3 grams of deionized water. The vanadium oxide sol was stirred overnight at room temperature (i.e., about 25° C.). The resulting sol was aged for six days at about 50° C., and then diluted with an equal amount of deionized water to provide a sol having a $V_2O_5$ equivalent of 1%.

Next, about 137 grams of deionized water, about 75 grams of the 21% solids aqueous Polymer B Dispersion, and about 0.3 gram of a surfactant ("TRITON X-100") were added sequentially to about 37.5 grams of the vanadium oxide sol having a $V_2O_5$ equivalent of 1%, prepared above, to provide a vanadium oxide/Polymer B dispersion.

About 5 grams of the vanadium oxide/Polymer B dispersion was added to about 50 grams of a epoxy-based resin dispersion containing 10% of an epoxy-based resin (commercially available under the trade designation "W60-5310" from Rhone-Poulenc of Louisville, Ky.) and 90% deionized water. The resulting dispersion did not flocculate. By contrast, a non-compatible bond sytem, such as illustrated in Comparative Examples I, J, K, and L, below, would flocculate.

Example 7

About 3 grams of an aliphatic amine adduct (an epoxy curing agent) solution containing 50% of an aliphatic amine adduct (commercially available under the trade designation "EPI-CURE 826" from Rhone-Poulenc) was added to the resulting dispersion of Example 4. The dispersion did not flocculate.

Comparative I

About 5 grams of Polymer B Solution was added to about 50 grams of a phenolic-based resin dispersion containing 10% of a phenolic resole resin having a phenol to formaldehyde ratio of about 1:1.8 and 90% deionized water. The resulting dispersion immediately flocculated.

Comparative J

About 5 grams of Polymer B Solution was added to about 50 grams of an animal hide glue dispersion containing 10% of an animal hide glue (commercially available under the trade designation "HIDE GLUE GRADE 2½" from Hudson Industries Corporation of Johnstown, N.Y.) and 90% deionized water. The resulting dispersion immediately flocculated.

Comparative K

About 5 grams of Polymer B Solution was added to about 50 grams of a zinc stearate solution containing 10% of zinc stearate (commercially available from Witco Corporation of Houston, Tex.) and 90% deionized water. The resulting dispersion immediately flocculated.

Comparative L

About 2 grams of polyoxypropylenediamine (commercially available under the trade designation "JEFFAMINE D-230" from Texaco Chemical Co. of Bellaire, Tex.) was added to Polymer B Solution. The resulting dispersion immediately flocculated.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising:

(a) a backing having a front surface;

(b) an abrasive layer bonded to said front surface of said backing to provide a coated abrasive article, said abrasive layer comprising abrasive grain and a cured bond system; and (c) vanadium oxide incorporated into said coated abrasive article, wherein said vanadium oxide is present in an amount sufficient to reduce the accumulation of static electric charge during the abrading of a workpiece with said coated abrasive article.

2. The coated abrasive article according to claim 1 wherein said backing further comprises a back surface and said abrasive layer further comprises a top surface, and wherein said vanadium oxide is at least one of:

(i) coated on said back surface of said backing;
(ii) incorporated into said backing;
(iii) coated onto said front surface of said backing;
(iv) incorporated into said abrasive layer; and
(v) coated onto said top surface of said abrasive layer.

3. The coated abrasive article according to claim 1 wherein said vanadium oxide comprises at least one of vanadium(+4) or vanadium(+5) oxidation states.

4. The coated abrasive article according to claim 1 further comprising a sulfopolymer in contact with said vanadium oxide.

5. The coated abrasive article according to claim 4 wherein said sulfonated polymer is selected from the group consisting of a sulfopolyester, a sulfopolyurethane, a sulfopolyurethane-urea, an ethylenically-unsaturated sulfopolymer, a sulfopolyester polyol, a sulfopolyol, and combinations thereof.

6. The coated abrasive article according to claim 4 wherein said sulfonated polymer is a sulfopolyester.

7. The coated abrasive article according to claim 4 wherein the weight ratio of said vanadium oxide to said sulfonated polymer is in the range from about 1:499 to about 1:1.

8. The coated abrasive article according to claim 4 wherein the weight ratio of said vanadium oxide to said sulfonated polymer is in the range from about 1:499 to about 1:4.

9. The coated abrasive article according to claim 4 wherein said vanadium oxide is dispersed in said sulfonated polymer to provide a layer comprising said vanadium oxide and said sulfonated polymer.

10. The coated abrasive article according to claim 4 wherein said sulfonated polymer is coated over said vanadium oxide.

11. The coated abrasive article according to claim 1 further comprising a layer comprising said vanadium oxide, said backing having a back surface, and said abrasive layer having a top surface, wherein layer comprising said vanadium oxide is coated onto at least one said back surface of said backing and said top surface of said abrasive layer.

12. The coated abrasive article according to claim 1 further comprising a supersize layer and said abrasive layer having a top surface, wherein said supersize layer is coated onto said top surface of said abrasive layer.

13. The coated abrasive article according to claim 12 wherein said supersize layer has a top surface and said vanadium oxide is coated onto said top surface of said supersize layer.

14. The coated abrasive article according to claim 12 wherein said supersize layer comprises a material selected from the group consisting of metal salts of fatty acids, urea-formaldehyde, novolak phenolic resins, waxes, mineral oils, and fluorochemicals.

15. The coated abrasive article according to claim 1 wherein said bond system is formed from materials selected from the group consisting of phenolic resins, urea-formaldehyde resins, melamine-formaldehyde resin, aminoplast resins, isocyanate resins, polyester resins, epoxy resins, acrylate reins, urethane resins, hide glue, and combinations thereof.

16. The coated abrasive article according to claim 1 wherein said backing is selected from the group consisting of paper, polymeric film, fiber, nonwoven fibrous material, cloth, treated versions thereof, and combinations thereof.

17. The coated abrasive article according to claim 1 wherein said abrasive grain is selected from the group consisting of fused aluminum oxide, co-fused alumina-zirconia, silicon carbide, diamond, cubic boron nitride, ceria, garnet, boron carbide, silica, silicon nitride, and combinations thereof.

18. A three-dimensional, low density abrasive article comprising (a) a three-dimensional, low density web structure;
(b) abrasive grain;
(c) a bond system that serves to bond said abrasive grain to said web structure;
(d) vanadium oxide incorporated into said three-dimensional, low density abrasive article, wherein said vanadium oxide is present in an amount sufficient to reduce the accumulation of static electric charge during the abrading of a workpiece with said three-dimensional, low density abrasive article.

19. The three-dimensional, low density abrasive article according to claim 18 wherein said vanadium oxide comprises at least one of vanadium(+4) or vanadium(+5) oxidation states.

20. The three-dimensional, low density abrasive article according to claim 18 further comprising a sulfopolymer in contact with said vanadium oxide.

21. The three-dimensional, low density abrasive article according to claim 20 wherein said sulfonated polymer is selected from the group consisting of a sulfopolyester, a sulfopolyurethane, a sulfopolyurethane-urea, an ethylenically-unsaturated sulfopolymer, a sulfopolyester polyol, a sulfopolyol, and combinations thereof.

22. The three-dimensional, low density abrasive article according to claim 20 wherein said sulfonated polymer is a sulfopolyester.

23. The three-dimensional, low density abrasive article according to claim 20 wherein the weight ratio of said vanadium oxide to said sulfonated polymer is in the rang from about 1:499 to about 1:1.

24. A method of making a coated abrasive article, said method comprising the steps of:

(a) providing a backing having a front surface;
(b) applying an abrasive layer to said front surface of said backing to provide a coated abrasive article, said abrasive layer comprising a bond system capable of being cured and abrasive grain;
(c) incorporating into said coated abrasive article a sufficient amount of vanadium oxide to provide a coated abrasive article having a reduced tendency to accumulate static electric charge during the abrading of a workpiece; and
(d) curing said curable bond system.

25. The method according to claim 24 wherein said backing has a back surface and said abrasive layer has a top surface, and said method further comprises the step of applying a layer comprising said vanadium oxide onto at least one said back surface of said backing and said top surface of said abrasive layer.

26. The method according to claim 24 wherein said abrasive layer has a top surface, and said method further comprises the step of applying a supersize layer onto said top surface of said abrasive layer.

27. The method according to claim 24 wherein said vanadium oxide is dispersed in a sulfonated polymer and incorporated into said coated abrasive article as a layer comprising said vanadium oxide and said sulfonated polymer.

28. The method according to claim 24 wherein said vanadium oxide is incorporated into said coated abrasive article as a layer, and said method further comprises the step of coating a sulfonated polymer over said layer of said vanadium oxide.

29. A method making a three-dimensional, low density abrasive article, said method comprising the steps of:

(a) providing a three-dimensional, low density web structure;

(b) appying a curable bond system and abrasive grain to said web structure;

(c) incorporating into said three-dimensional, low density abrasive article a sufficient amount of vanadium oxide to provide a three-dimensional, low density abrasive article having a reduced tendency to accumulate static electric charge during the abrading of a workpiece; and (d) curing said curable bond system.

30. The method according to claim 29 wherein said vanadium oxide is dispersed in a sulfonated polymer and incorporated into said three-dimensional, low density abrasive article as a layer comprising said vanadium oxide and said sulfonated polymer.

31. The method according to claim 29 wherein said vanadium oxide is incorporated into said three-dimensional, low density abrasive article as a layer, and said method further comprises the step of coating a sulfonated polymer over said layer of said vanadium oxide.

32. The coated abrasive article according to claim 1 wherein said abrasive grain is ceramic aluminum oxide.

* * * * *

UNITED STATES PATENT AND TRADEMARK OFFICE

CERTIFICATE OF CORRECTION

PATENT NO. : 5,203,884

DATED : April 20, 1993

INVENTOR(S) : Scott J. Buchanan et al.

It is certified that error appears in the above-identified patent and that said Letters Patent is hereby corrected as shown below:

Column 13, line 9, "$HOOC(CH_2)_cCOOH$" should read --$HOOC(CH_2)_cCOOH$--.

Column 17, line 63, "pat." should read --Pat.--.

Column 25, line 67, "reins" should read --resins--.

Column 26, line 45, "rang" should read --range--.

Signed and Sealed this

Twenty-second Day of March, 1994

Bruce Lehman

*Attest:*

BRUCE LEHMAN

*Attesting Officer*

*Commissioner of Patents and Trademarks*